US007281941B1

(12) United States Patent
Libby, II et al.

(10) Patent No.: US 7,281,941 B1
(45) Date of Patent: Oct. 16, 2007

(54) STRIPPING AND CONTACT DEVICE FOR AN INSULATION DISPLACEMENT CONNECTOR

(75) Inventors: Charles A. Libby, II, Montoursville, PA (US); Robert A. Libby, Williamsport, PA (US); David E. Montgomery, Montoursville, PA (US); Kyle Mason, Williamsport, PA (US)

(73) Assignee: Aslan Industries, Corporation, Montoursville, PA (US)

( * ) Notice: Subject to any disclaimer, the term of this patent is extended or adjusted under 35 U.S.C. 154(b) by 0 days.

(21) Appl. No.: 11/732,839

(22) Filed: Apr. 4, 2007

(51) Int. Cl.
*H01R 11/20* (2006.01)

(52) U.S. Cl. ..... 439/409

(58) Field of Classification Search ..... 439/409–413, 439/417

See application file for complete search history.

(56) References Cited

U.S. PATENT DOCUMENTS 4,891,018 A * 1/1990 Afflerbaugh et al. ..... 439/417
5,067,910 A * 11/1991 Knox et al. ..... 439/417
5,785,551 A 7/1998 Libby
5,947,761 A * 9/1999 Pepe ..... 439/409
5,975,938 A 11/1999 Libby et al.
6,074,238 A 6/2000 DeRoss
6,799,989 B2 * 10/2004 Doorhy et al. ..... 439/404
7,134,904 B2 * 11/2006 Bergner et al. ..... 439/410
7,144,269 B2 12/2006 Libby

* cited by examiner

*Primary Examiner*—Briggitte R. Hammond
(74) *Attorney, Agent, or Firm*—Thomas R. Shaffer

(57) ABSTRACT

A stripping and contact device for an insulation displacement connector is provided. The device has a body which has a cavity therein sized to receive an unstripped end of insulated electrical cable. A lid is pivotally connected to a body and moves around an axis of rotation between and open position and a closed position. Plural metallic contact plates, including a hot contact plate, a neutral contact plate, and at least one ground contact plate, are spaced apart and attached to the lid. When the lid is in open position the contact plates do not extend within said cavity and when the lid in a closed position the contact plates do extend within said cavity. A pair of insulating wedges is provided. A first wedge is juxtaposed between said hot contact plate and a ground contact plate. A second wedge is juxtaposed between a ground contact plate and a neutral contact plate. Angled surfaces on the wedges perform multiple functions during a closing operation of the device.

23 Claims, 15 Drawing Sheets

PRIOR ART

FIG. 10
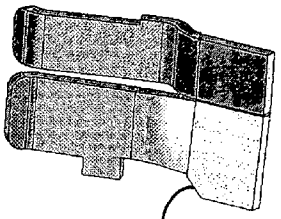
Fig 10a
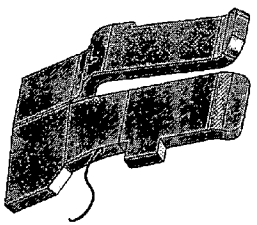
Fig 10b
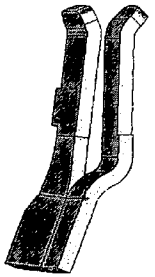
Fig 10c
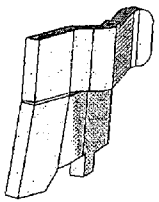
Fig 10d
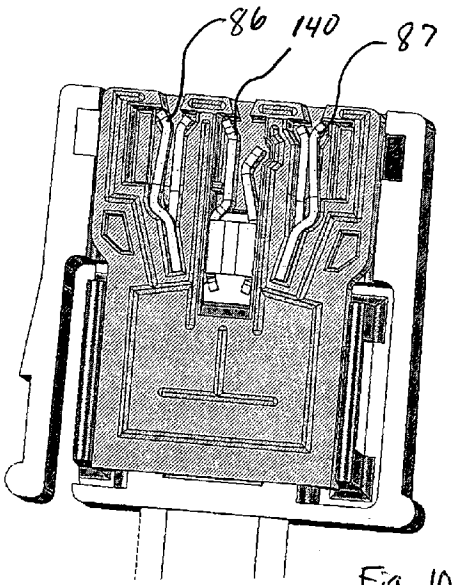
Fig 10e
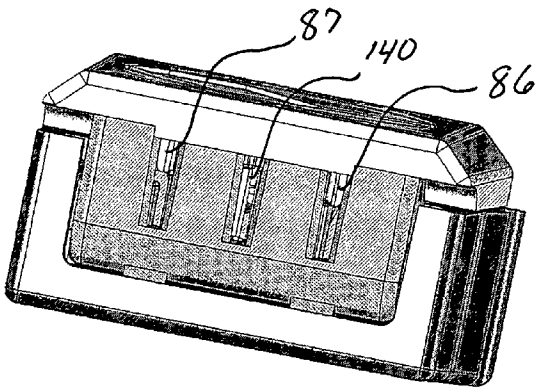
Fig 10f

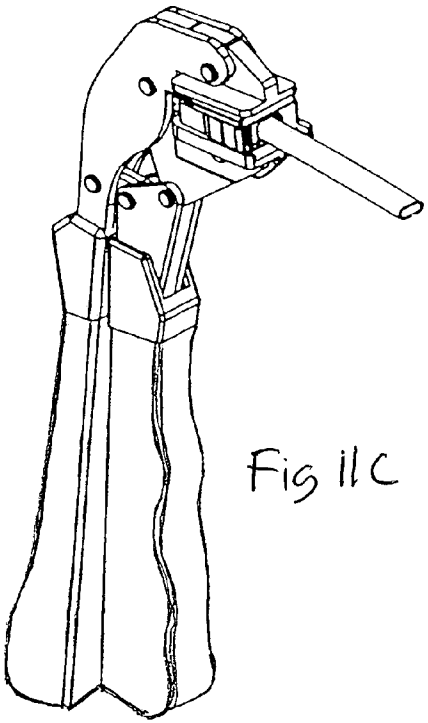
Fig 11c
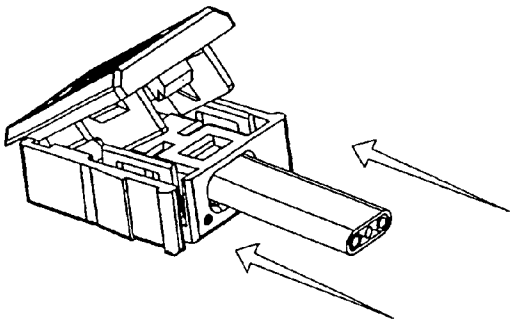
Fig 11b
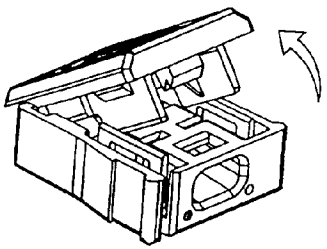
Fig 11a
FIG. 11

STRIPPING AND CONTACT DEVICE FOR AN INSULATION DISPLACEMENT CONNECTOR

BACKGROUND OF THE INVENTION

1. Field of the Invention

The present invention relates to a stripping and contact device for insulated cable. More specifically, it relates to manufactured plastic wedges and metallic contact plates in an electrical connector for insulated cable.

2. Description of the Prior Art

The purpose of an insulation displacement connector (IDC) is to make a connection between the metallic conductors of an insulated cable and the metallic contacts in the connector. This is done to transfer electric current from the current carrying cable to the connector which then delivers current to any device or another cable. IDC's eliminate the manual stripping action of insulation from electrical conductors and the use of wire nuts to terminate these conductors.

Prior to the present invention, connections were made by compressing a forked shape device into and through the insulation of a wire conductor and contacting the metal wire. An example of this device is shown in DeRoss et al, FIGS. 5-7, of U.S. Pat. No. 6,074,238. In Libby et al, U.S. Pat. No. 5,975,938, FIGS. 2, 3, & 4 the insulation displacement is completed by piercing the wire with a rotating metal wheel. In yet another application the insulation is pierced and cut with a single pointed and sharpened blade illustrated in Libby U.S. Pat. No. 5,785,551, FIG. 13*c* and Libby U.S. Pat. No. 7,144,269, FIGS. 6-10. The DeRoss '238 patent teaches that it is necessary to manually remove the outer jacket of NM-B cable and place the individual wire conductors in the connector seen in FIGS. 17 and 18 of the patent. The Libby patents suggest that the NM-B cable is inserted into the connector without removing the outer jacket. As stated in the patent, NM-B or Romex® cable is a multi conductor cable which has a bare ground wire and at least two insulated conductors, one called a hot wire, and one called the neutral. These wires are then encased by an outer jacket or sheathed insulator. NM-B cable is primarily used in the wiring of residential homes to provide electricity throughout. The present invention relates to a new and improved set of metal plates or contact strips along with plastic wedge supports to perform the task for an IDC. The present invention will follow the piercing ground blades 140 (FIG. 5) of the prior art, a insulating wedges 107 (FIG. 6) will then peel away the insulation on the individual wire conductors, create a gas tight connection between the wire and the metal contact strips, and push the excess insulation down into a formed reservoir.

SUMMARY OF THE INVENTION

In its simplest form the present invention provide a stripping and contact device for an insulation displacement connector which comprising: a) a body having a cavity therein sized to receive said unstripped end of insulated electrical cable; b) a lid pivotally connected to said body and movable around an axis of rotation between an open position and a closed position; c) plural metallic contact plates, including a hot contact plate, a neutral contact plate, and at least one ground contact plate, said contact plates being spaced apart and attached to the lid whereby when said lid is in open position said contact plates do not extend within said cavity and when said lid in a closed position said contact plates do extend within said cavity; and d) a pair of insulating wedges including a first wedge juxtaposed between said hot contact plate and said at least one ground contact plate and a second wedge juxtaposed between said neutral contact plate and said at least one ground contact plate.

Preferably, said at least one ground contact plate comprises a pair of spaced apart ground contact plates. Said first wedge is preferably in a sealed airtight contact with said hot contact plate and with one of said pair of ground contact plates and said second wedge is preferably in a sealed airtight contact with said neutral contact plate and with one of said pair of ground contact plates.

Preferably each of said pair of insulating wedges further comprises: a top cutting edge, a front edge, a back edge, an angled outside surface, an inside surface and an angled wedge surface. Said inner surface of each of said pair of insulating wedges are preferably parallel to each other.

The outer surface of each wedge is preferably formed at an angle A (FIG. 6A) relative to said inner surface, with said angle A being between 5 degrees and 45 degrees and preferably approximately 20 degrees. Preferably the angled wedge surface of each wedge includes said top cutting edge and has a bottom edge formed at an angle B (FIG. 6B) relative to said top cutting edge with said angle B being between 5 degrees and 45 degrees and preferably approximately 20 degrees. The top cutting edge of each wedge is preferably formed at an angle C relative to said inner surface with said angle C (FIG. 6D) being between 110 degrees and 170 degrees and preferably approximately 150 degrees.

Preferably, when said lid moves from said open position to said closed position, said wedges cut through an outer jacket of an unstripped end of insulated electrical cable inserted in said cavity.

Preferably, when said lid moves from said open position to said closed position, said wedges push apart a hot insulated conductor wire and a neutral insulated conductor wire of an unstripped end of insulated electrical cable inserted in said cavity.

Preferably, when said lid moves from said open position to said closed position, said wedges strip insulation off from a hot insulated conductor wire and a neutral insulated conductor wire of an unstripped end of insulated electrical cable inserted in said cavity exposing bare copper causing an electrical connection with said metallic contact plates.

Preferably, when said lid is moved to a closed position with and unstripped end of insulated electrical cable inserted in said cavity said wedges insulate from one another a hot conductor, a neutral conductor and a ground conductor of said cable.

Preferably, when said lid moves from said open position to said closed position, said wedges push insulation from an unstripped end of insulated electrical cable inserted in said cavity into a reservoir provided for such insulation.

Preferably said wedges support and hold said plural metallic contact plates in position and said metallic contact plates are shaped to lay flush against said insulating wedges.

Preferably, when said lid is moved to a closed position with and unstripped end of insulated electrical cable inserted in said cavity said metallic contact plates peel away insulation which is not removed by said wedges. Preferably, said metallic contact plates make a gas tight seal with conductors of unstripped end of insulated electrical cable inserted in said cavity and preferably said metallic contact plates have split ends to receive a male plug pin.

Preferably, when said lid moves from said open position to said closed position, said metallic contact plates aid in pushing insulation from an unstripped end of insulated electrical cable inserted in said cavity into a reservoir provided for such insulation.

BRIEF DESCRIPTION OF THE FIGURES

FIGS. 10*a*, 10*b*, 10*c*, 10*d*, 10*e* and 10*f* are various perspective view of the metallic contact strips of the present invention both alone and as assembled in the stripping device.

FIGS. 11*a*, 11*b* and 11*c*, respectively, show perspective views of the stripping device in an open position, in an open position with cable inserted, and in a closed position as closed by a pliers device

DETAILED DESCRIPTION OF THE PREFERRED EMBODIMENTS

Figure 2:
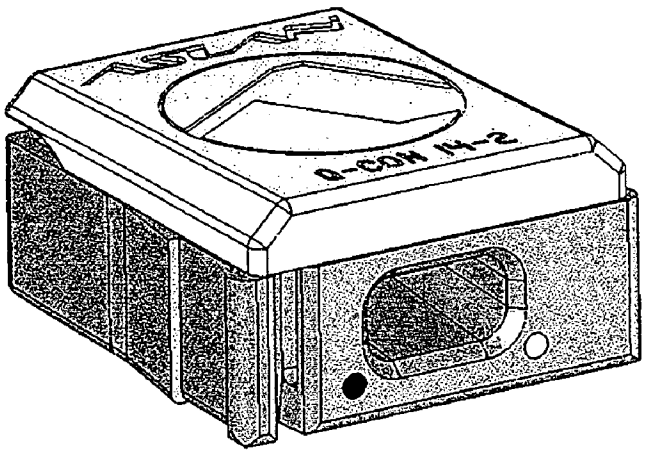
FIG. 2 a perspective view of the present invention in a closed position.
Figure 1:
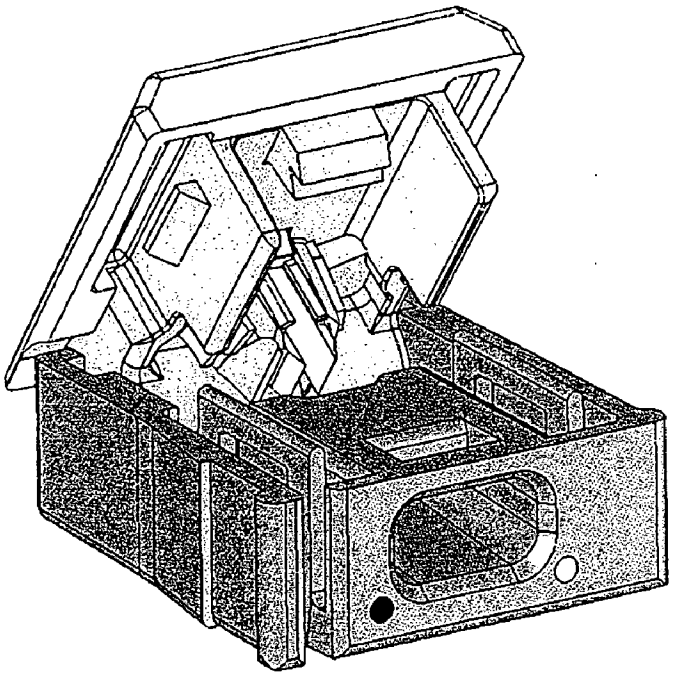
FIG. 1 a perspective view of the present invention in an open position.
Figure 1C:
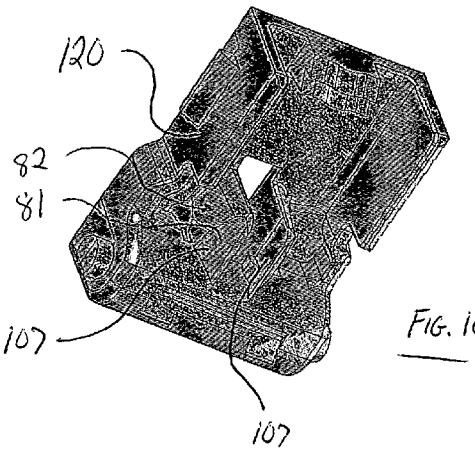
Figure 1D:
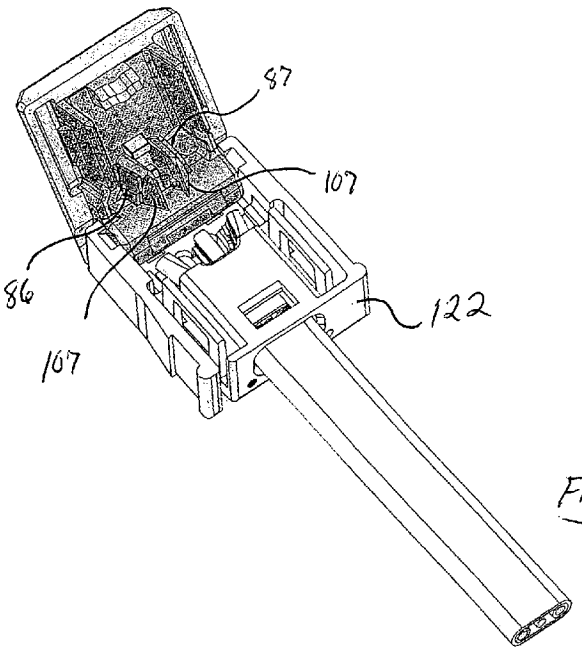
Figure 1B:
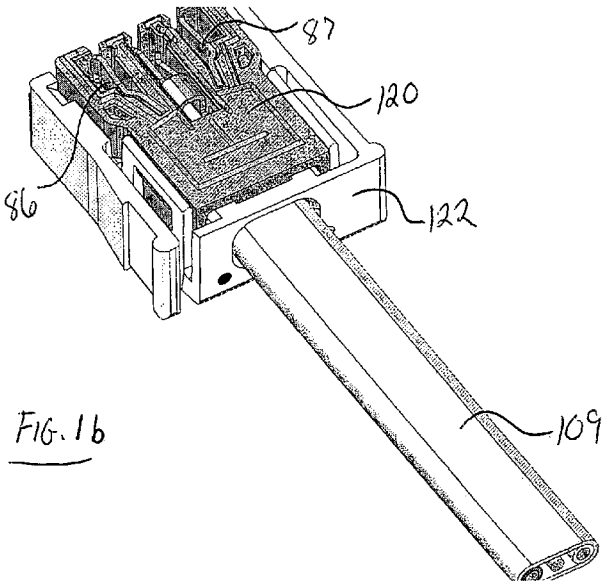
Figure 1A:
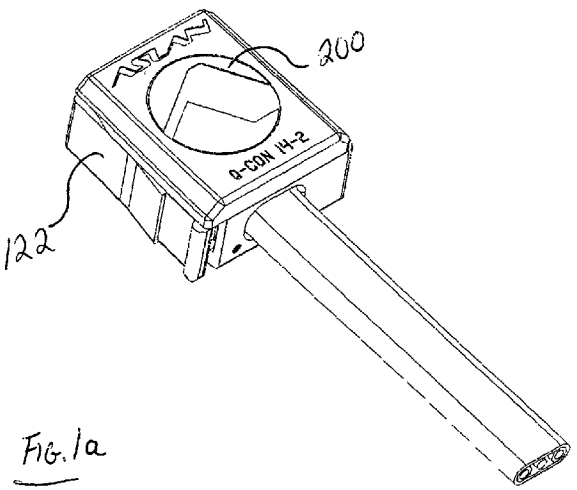
Figure 5:
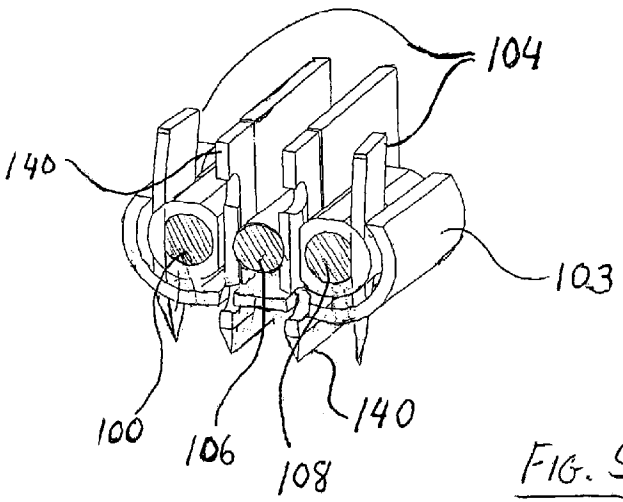
FIG. 5 (PRIOR ART)
FIG. 5 is a prior art device which utilizes sharpened blades to pierce the insulation of a sheathed cable and insulated wires.
Figure 3:
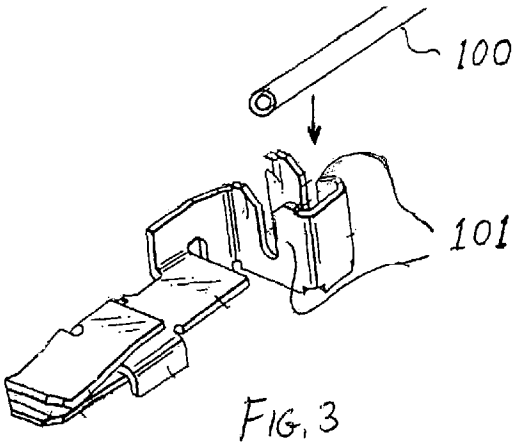
FIG. 3 (PRIOR ART)
FIG. 3 is a prior art device which shows a forked device to make a connection to unsheathed insulated wires.
Figure 4:
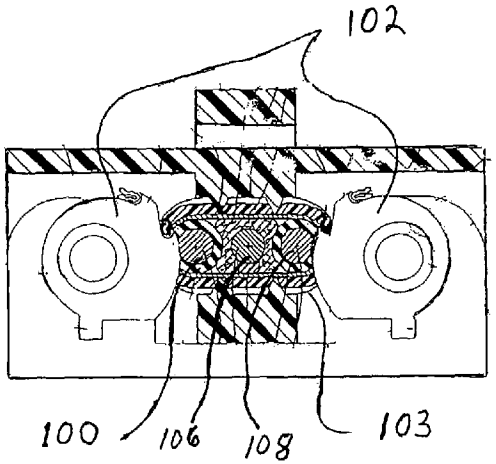
FIG. 4 (PRIOR ART)
FIG. 4 is a prior art device which utilizes a rotating metal wheel to make a connection to sheathed insulated wires.

The present invention is adapted for a quick connect insulation displacement connector (IDC) of the type described in Libby, U.S. Pat. No. 7,144,269 and Libby, U.S. Pat. No. 5,975,938. The IDC connector is represented in FIGS. 1 and 2 showing an opened and closed view. FIGS. 3, 4, & 5, illustrate prior art showing three known types of IDC connections. FIG. 3, which is from DeRoss et, U.S. Pat. No. 6,074,238, shows the forked type terminals 101 with one of the conductors of an unsheathed wire 100 to be pressed down into the forked device making the connection. Represented in FIG. 4 is the Libby U.S. Pat. No. 5,975,938 device illustrating the rotating metal wheels 102, the sheathed cable 103, and the wire conductors 100, 106 and 108. Note that the wire conductors still have the sheathed outer insulation on them. FIG. 5 shows the teachings of Libby U.S. Pat. No. 7,144,269 where sharpened blades 104 pierce the sheathed cable 103 and the individual wire conductors 100 and 108. The ground blade 140 cuts the outer jacket and is pushed down to make contact with the ground wire.

The present invention is manufactured into a lower lid 120 of the general type shown in FIGS. 1*a* through 1*d* and 6 herein. As the upper lid 200 and lower lid is closed onto the sheathed NM-B cable and locks into the body 122 as shown in FIGS. 1 a through 1*d*, the piercing of the sheathed cable, the stripping of the individual insulated wires, and the gas tight seal to the conductors, is totally accomplished.

Figure 6:
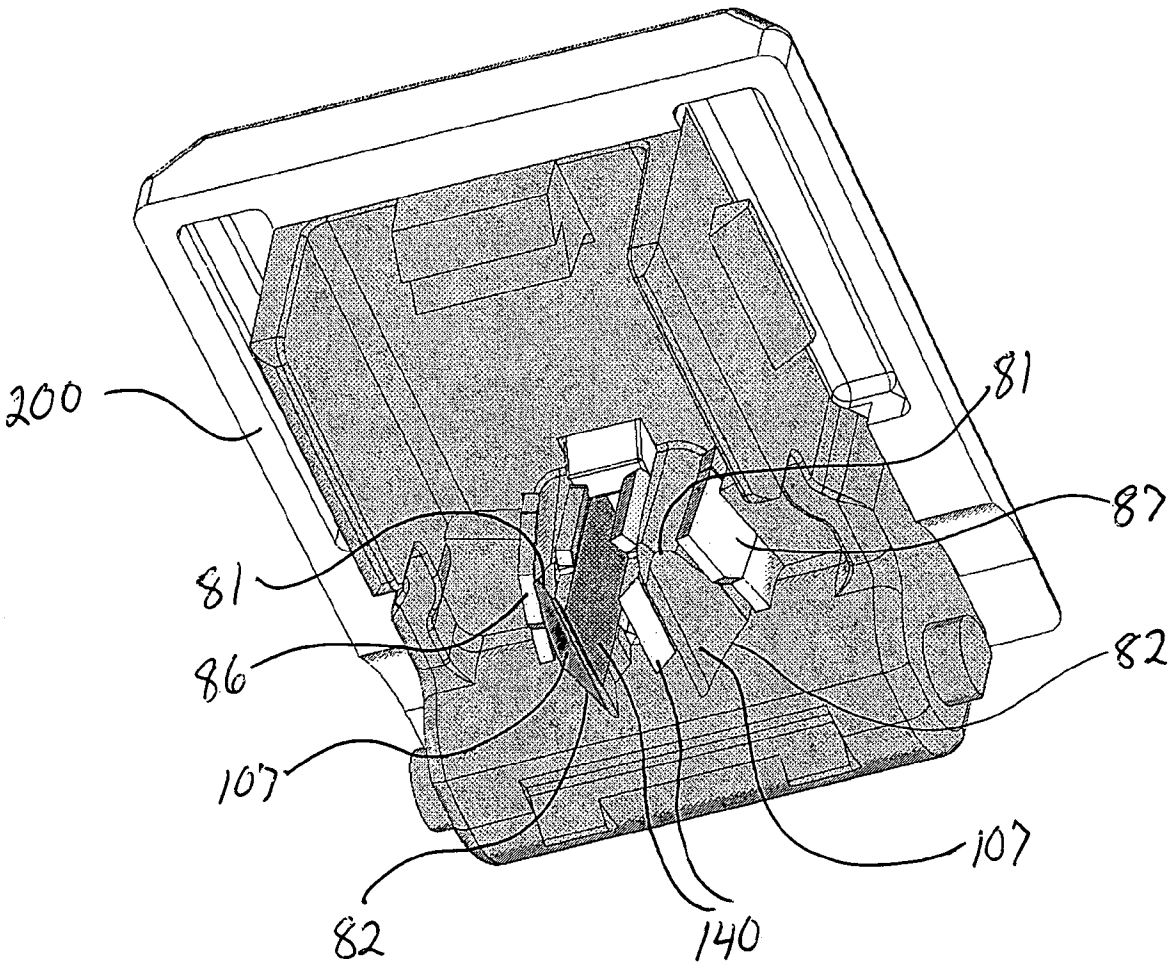
FIG. 6 is a perspective view of the lid of the present invention showing the insulated wedges.
Figure 6B:
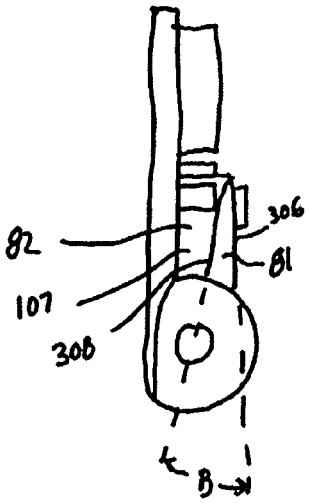
FIG. 6B is a side elevation view of the lid of the present invention.
Figure 6A:
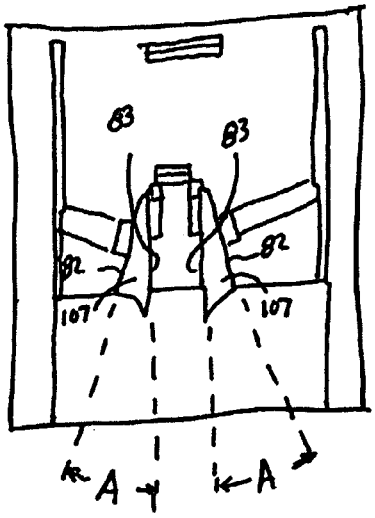
FIG. 6A a top plan view of the lid of the present invention.
Figure 6C:
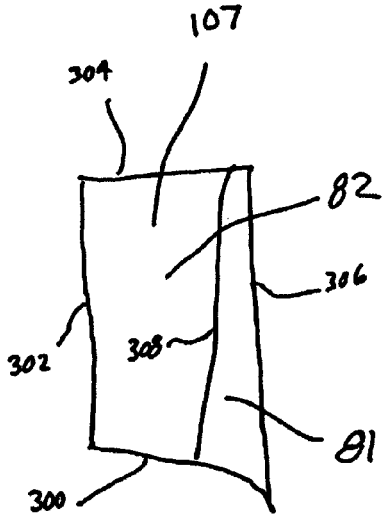
FIG. 6C is a side elevation view of a wedge of the present invention.
Figure 6D:
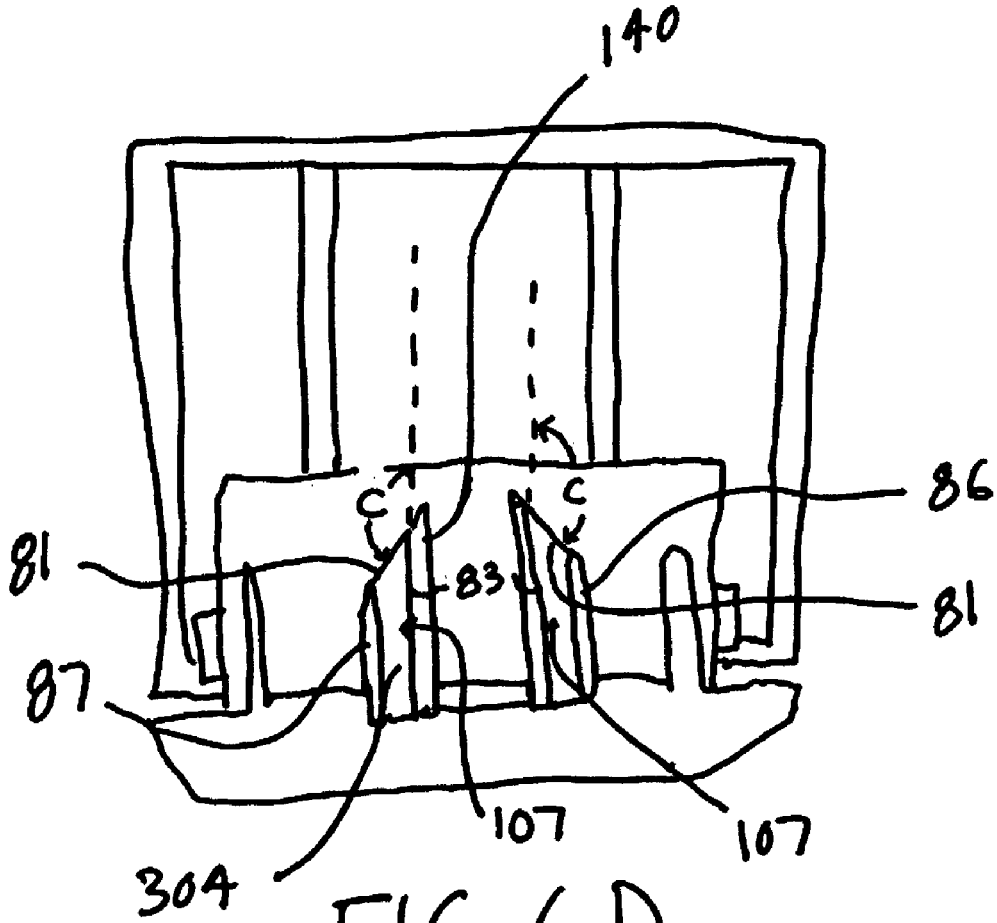
FIG. 6D is a front elevation view of the lid of the present invention in an open position on the body.
Figure 7:
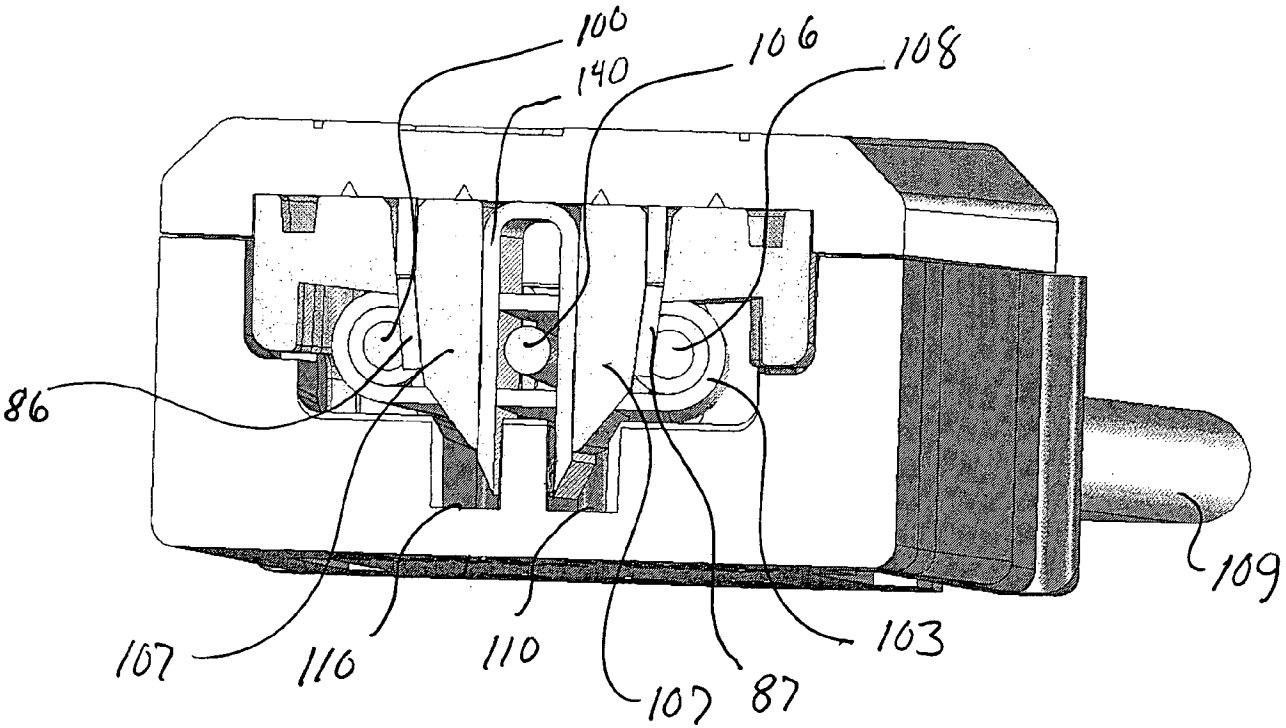
FIG. 7 is a perspective cutaway view of the lid and body in a closed position.
Figure 8:
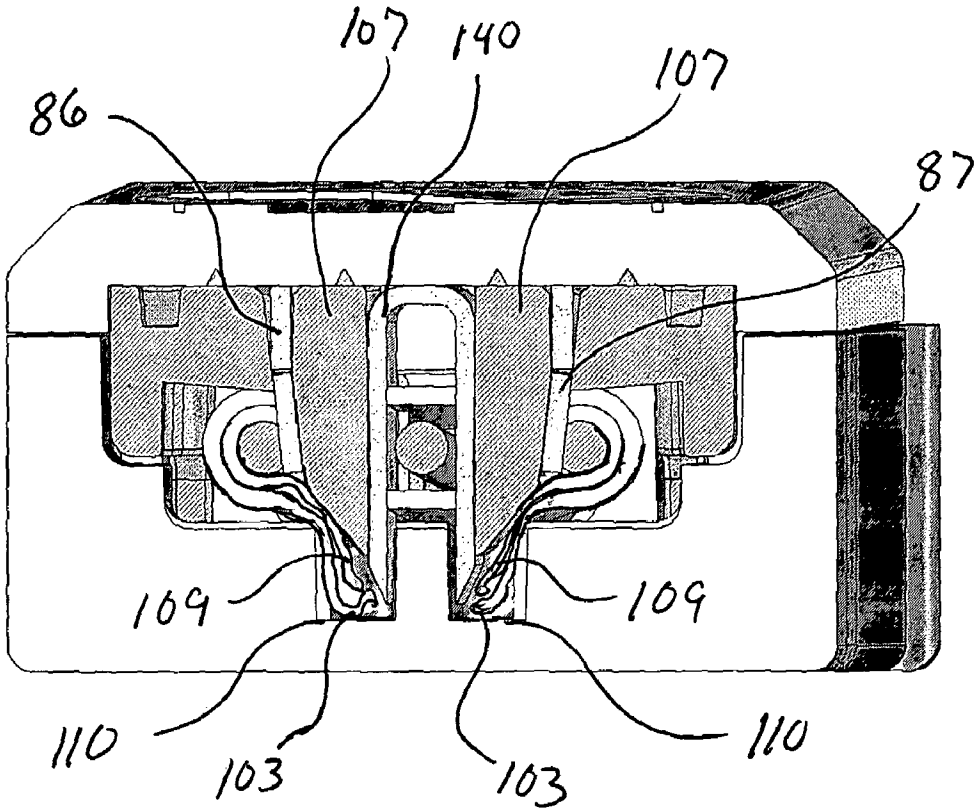
FIG. 8 is a perspective cutaway view of the lid and body in a closed position with insulation pushed into a reservoir.
Figure 8A:
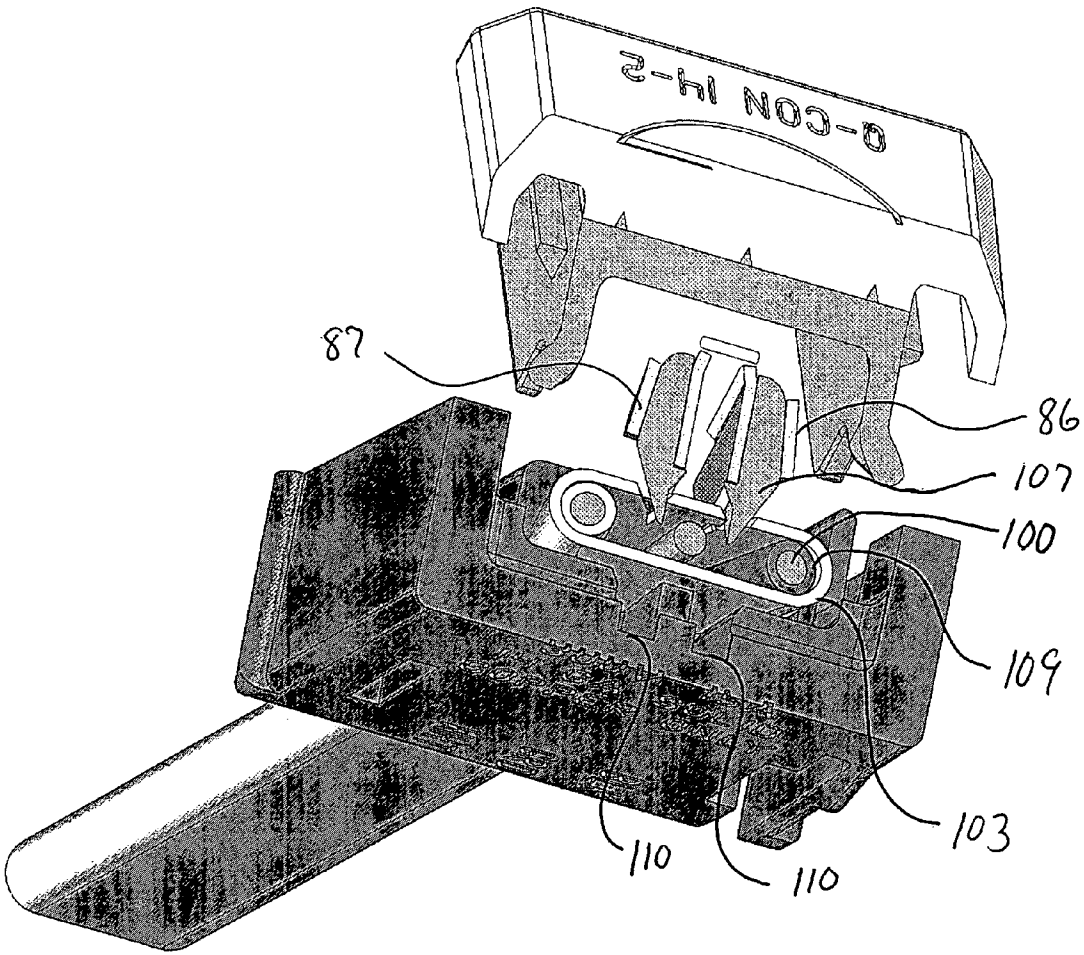
FIGS. 8*a*, 8*b*, 8*c*, and 8*d*, show, respectively, perspective views of the stripping device of the present invention in a fully open, a one quarter closed position, a three quarter closed position and a fully closed position.
Figure 8B:
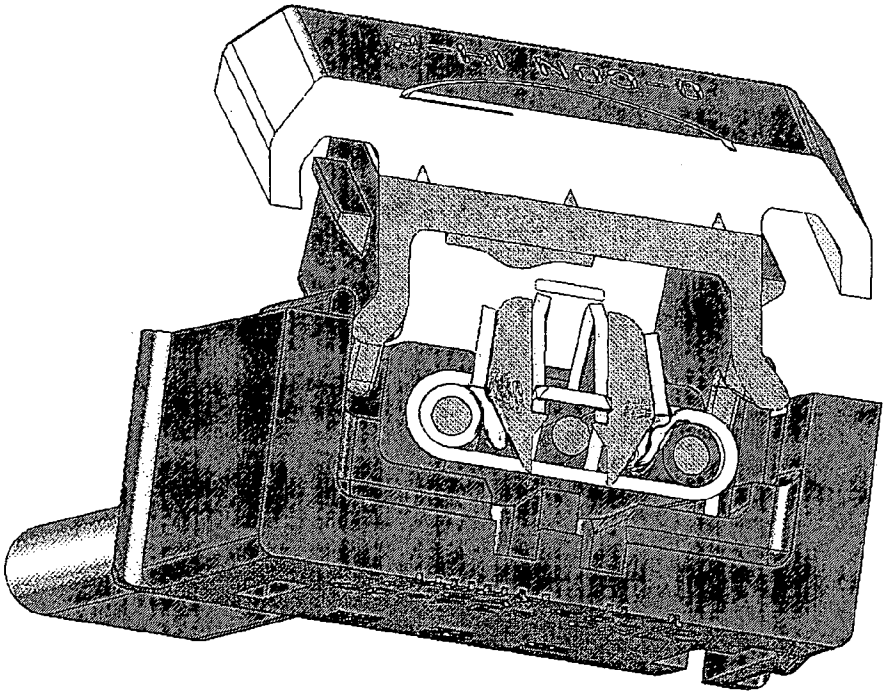
Figure 8C:
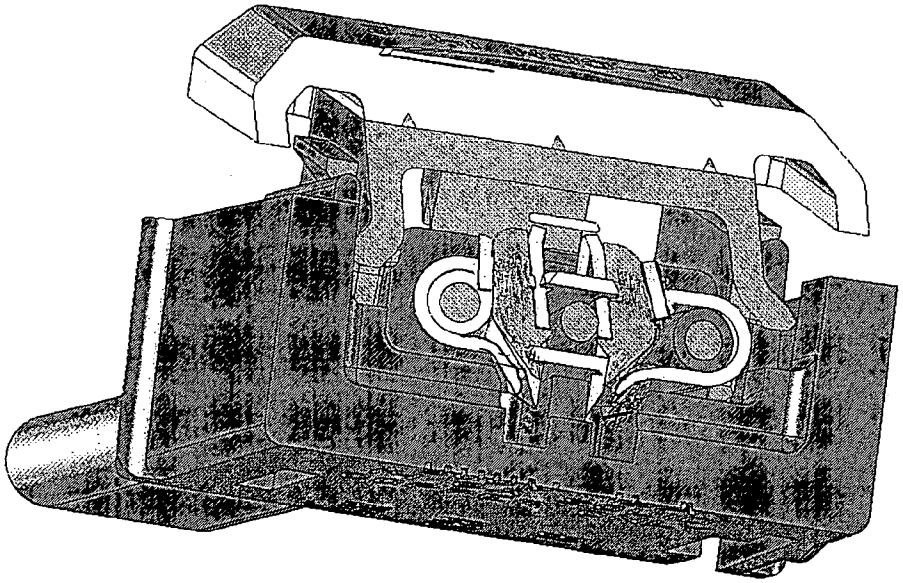
Figure 8D:
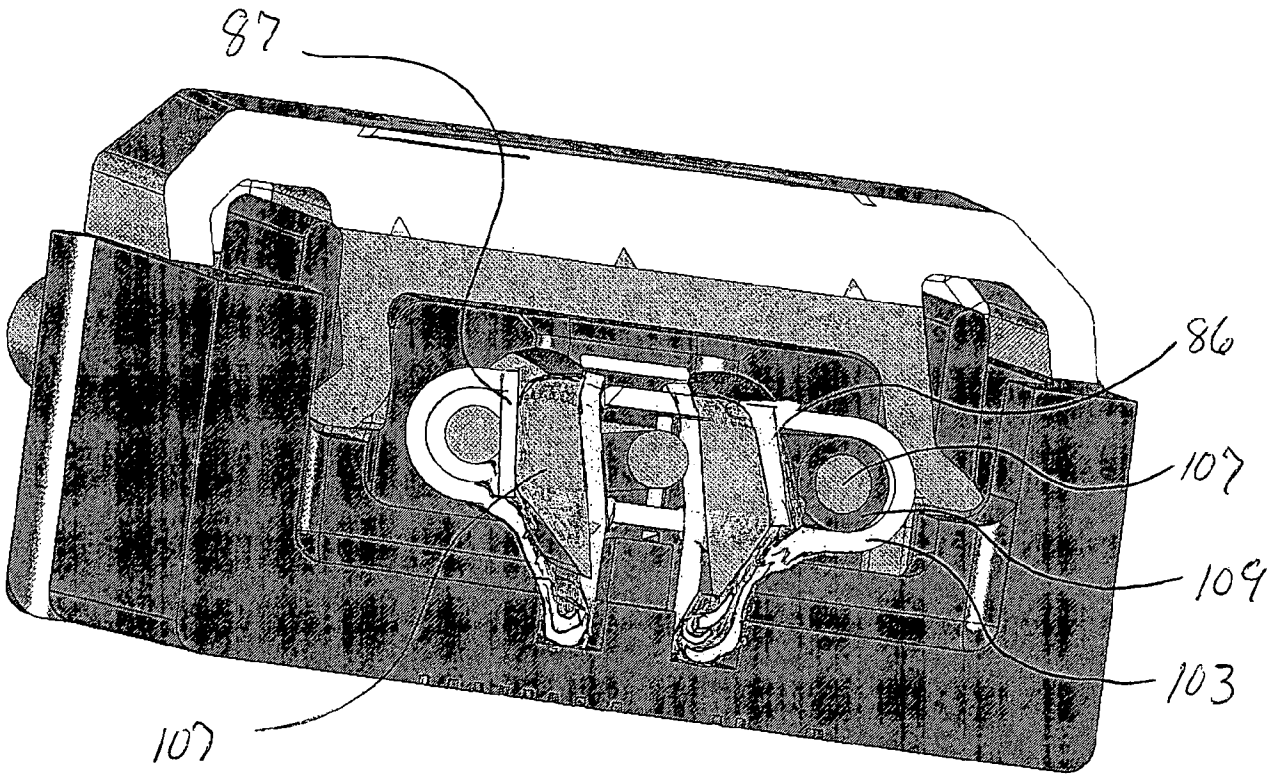
Figure 9:
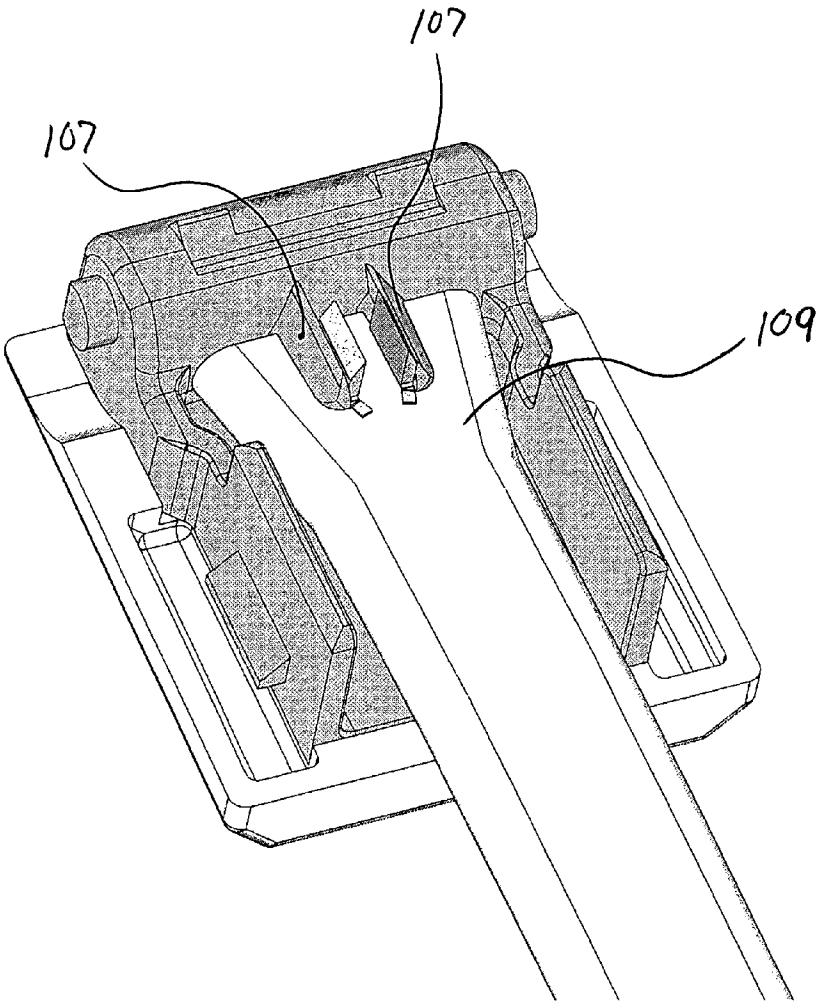
FIG. 9 is a perspective view of the lid of the present invention as closed upon an unstripped end of an electrical cable.

When the lid closes, the insulating plastic wedges 107 shown in FIGS. 6 and 7, follow the ground stampings 140 which cut through the outer jacket 103 of the inserted Romex®, down through the cable. The insulating plastic wedges 107 are specifically designed with compound angled surfaces 81 and 82 shown in FIGS. 1*c*, 6 and 6A through 6D that enable them to perform six unique tasks. First, the outer jacket, as previously stated, is cut by the ground blade 140 as the lid closes. While being closed, the plastice wedges 107 also go down into the jacket. Second, the two insulated conductors, hot and neutral, are pushed apart by the first angled surface 81 on the wedges. Third, the insulation is pulled off of the conductors by the angled wedges 107 allowing the bare copper to be exposed in order for the metallic contact plates 86 and 87 (FIG. 1*b*, 6, 7 and 10*a* through 10*f*) to make contact with each of the conductors. Fourth, the second angled surface 82 spreads the insulated conductors (hot & neutral) even further allowing the metallic blades to aid in peeling off the remaining insulation as described later. Fifth, the sheathed jacket 103 FIG. 7 and the insulation 109 is pushed down and out of the way into a manufactured reservoir 110. And sixth, the wedges 107 insulate the three wires which is required by the National Electric Code and also support the metallic contact plates (hot and neutral stampings). The end result is shown in FIGS. 8 illustrating the insulation 109 and the outer sheathed jacket 103, being pushed down in the reservoirs 110 of the connector. In FIGS. 8*a* through 8*d* this sequence is shown in step form from the lid fully opened (FIG. 8*a*) to the lid fully closed (FIG. 8*d*). In FIG. 9 we see how the NM-B cable 109 is spread apart and the conductors are insulated.

The metallic contact plates or stampings 86 and 87 are formed from a copper alloy and make the connections to the wire in the connector. These hot and neutral contact plates 86 and 87 (FIGS. 1*b*, 6, 7, 8 and 10*a* through 10*e*) are specifically designed and shaped to lay flush against the plastic wedges 107 and perform four distinct functions. First, the contact plates 86 and 87 peel away any insulation that the plastic wedges 107 may leave behind thus cleaning the wire conductors. Second, because of the pressure created by spreading the conductors apart by the plastic wedges 107, they create a perfect gas tight seal between them and the wire conductors. Third, electric current is transferred from the wire to these metallic contact plates 86 and 87 and out through the designed split ends 91 (FIGS. 10*a* through 10*e*), where a metal male pin is captured to receive the current. And fourth, during the closing of the lid the contact plates 86 and 87 aid in pushing the insulation down into the reservoirs 110 (FIGS. 7, 8 through 8*d*). Various views of the metallic contact plates 86 and 87 are shown in FIGS. 10*a* through 10*e*, along with the front of the connector allowing a view of the split end area of the contract plates 86 and 87.

This new devise when manufactured in the quick connect electrical connector will allow the electrical contractor or end user to simply insert NM-B cable into the connector and in one easy movement close the connector and terminate three electrical conductors without manually stripping the sheathed cable or the insulated conductors. This process is illustrated in FIGS. 11*a* through 11*c*. The connector will then perform the function of joining or coupling two cables together and also to be used as a connection means into wiring devices such as receptacles and switches.

Referring specifically to FIGS. 6, 6A, 6B, 6C and 6D the stripping and contact device according to the present invention has a pair of insulating wedges 107 which each further comprise: a top cutting edge 306, a front edge 304, a back edge 300, a base edge 302, an angled outside surface 82, an inside surface 83 and an angled wedge surface 81. The inner surface 83 of each of said pair of insulating wedges 107 are parallel to each other. The outer surface 82 of each wedge 107 is formed at an angle A (FIG. 6A) relative to said inner surface 83. Angle A is between 5 degrees and 45 degrees and is preferably approximately 20 degrees.

The angled wedge surface 81 of each wedge 107 includes said top cutting edge 306 and has a bottom edge 308 formed at an angle B (FIG. 6B) relative to said top cutting edge 306. Angle B is between 5 degrees and 45 degrees and is preferably approximately 20 degrees.

The top cutting edge 306 of each wedge 107 is formed at an angle C (FIG. 6D) relative to said inner surface. Angle C is between 110 degrees and 170 degrees and is preferably approximately 150 degrees.

It is to be understood that while certain forms of the present invention have been illustrated and described herein, the present invention is not to be limited to the specific forms or arrangements of parts described and shown.

We claim:

1. A stripping and contact device for an insulation displacement connector comprising:

a) a body having a cavity therein sized to receive said unstripped end of insulated electrical cable;

b) a lid pivotally connected to said body and movable around an axis of rotation between and open position and a closed position;

c) plural metallic contact plates, including a hot contact plate, a neutral contact plate, and at least one ground contact plate, said contact plates being spaced apart and attached to the lid whereby when said lid is in open position said contact plates do not extend within said cavity and when said lid in a closed position said contact plates do extend within said cavity; and d) a pair of insulating wedges including a first wedge juxtaposed between said hot contact plate and said at least one ground contact plate and a second wedge juxtaposed between said neutral contact plate and said at least one ground contact plate.

2. A stripping and contact device according to claim 1 wherein said at least one ground contact plate comprises a pair of spaced apart ground contact plates.

3. A stripping and contact device according to claim 2 wherein said first wedge is in a sealed airtight contact with said hot contact plate and with one of said pair of ground contact plates.

4. A stripping and contact device according to claim 2 wherein said second wedge is in a sealed airtight contact with said neutral contact plate and with one of said pair of ground contact plates.

5. A stripping and contact device according to claim 1 wherein each of said pair of insulating wedges further comprises: a top cutting edge, a front edge, a back edge, an angled outside surface, an inside surface and an angled wedge surface.

6. A stripping and contact device according to claim 5 wherein said inner surface of each of said pair of insulating wedges are parallel to each other.

7. A stripping and contact device according to claim 6 wherein said outer surface of each wedge is formed at an angle A relative to said inner surface, said angle A being between 5 degrees and 45 degrees.

8. A stripping and contact device according to claim 7 wherein said angle A is approximately 20 degrees.

9. A stripping and contact device according to claim 5 wherein angled wedge surface of each wedge includes said top cutting edge and has a bottom edge formed at an angle B relative to said top cutting edge, said angle B being between 5 degrees and 45 degrees.

10. A stripping and contact device according to claim 9 wherein said angle B is approximately 20 degrees.

11. A stripping and contact device according to claim 5 wherein said top cutting edge of each wedge is formed at an angle C relative to said inner surface, said angle C being between 110 degrees and 170 degrees.

12. A stripping and contact device according to claim 11 wherein said angle C is approximately 150 degrees.

13. A stripping and contact device according to claim 1 whereby when said lid moves from said open position to said closed position, said wedges cut through an outer jacket of an unstripped end of insulated electrical cable inserted in said cavity.

14. A stripping and contact device according to claim 1 whereby when said lid moves from said open position to said closed position, said wedges push apart a hot insulated conductor wire and a neutral insulated conductor wire of an unstripped end of insulated electrical cable inserted in said cavity.

15. A stripping and contact device according to claim 1 whereby when said lid moves from said open position to said closed position, said wedges strip insulation off from a hot insulated conductor wire and a neutral insulated conductor wire of an unstripped end of insulated electrical cable inserted in said cavity exposing bare copper causing an electrical connection with said metallic contact plates.

16. A stripping and contact device according to claim 1 whereby when said lid is moved to in a closed position with and unstripped end of insulated electrical cable inserted in said cavity said wedges insulate from one another a hot conductor, a neutral conductor and a ground conductor of said cable.

17. A stripping and contact device according to claim 1 whereby when said lid moves from said open position to said closed position, said wedges push insulation from an unstripped end of insulated electrical cable inserted in said cavity into a reservoir provided for such insulation.

18. A stripping and contact device according to claim 1 wherein said wedges support and hold said plural metallic contact plates in position.

19. A stripping and contact device according to claim 1 wherein said metallic contact plates are shaped to lay flush against said insulating wedges.

20. A stripping and contact device according to claim 1 whereby when said lid is moved to in a closed position with and unstripped end of insulated electrical cable inserted in said cavity said metallic contact plates peel away insulation which is not removed by said wedges.

21. A stripping and contact device according to claim 1 wherein said metallic contact plates make a gas tight seal with conductors of unstripped end of insulated electrical cable inserted in said cavity.

22. A stripping and contact device according to claim 1 wherein said metallic contact plates have split ends to receive a male plug pin.

23. A stripping and contact device according to claim 1 whereby when said lid moves from said open position to said closed position, said metallic contact plates aid in pushing insulation from an unstripped end of insulated electrical cable inserted in said cavity into a reservoir provided for such insulation.

* * * * *